US005406869A

United States Patent [19]

Prochnow et al.

[11] Patent Number: 5,406,869

[45] Date of Patent: Apr. 18, 1995

[54] AIR BEARING SUPPORT ASSEMBLY FOR PAPER SLITTING APPARATUS

[75] Inventors: Timothy C. Prochnow; Carl R. Marschke, both of Phillips, Wis.

[73] Assignee: Marquip, Inc., Phillips, Wis.

[21] Appl. No.: 122,913

[22] Filed: Sep. 16, 1993

[51] Int. Cl.[6] ..... B26D 1/15

[52] U.S. Cl. ..... 83/22; 83/169; 83/477.2; 83/676

[58] Field of Search ..... 83/169, 22, 349, 508, 83/477.2, 676

[56] References Cited

U.S. PATENT DOCUMENTS

| | | | |
|---|---|---|---|
| 3,133,572 | 5/1964 | Graef | 83/676 X |
| 3,763,748 | 10/1973 | Gallagher, Jr. | 83/508 X |
| 4,627,214 | 12/1986 | Anderson et al. | 83/71 |
| 4,715,254 | 12/1987 | DeGan | 83/169 |
| 4,813,319 | 3/1989 | Weyand, Jr. | 83/169 X |
| 4,967,963 | 11/1990 | Brown | 83/169 X |
| 5,090,281 | 2/1992 | Paulson et al. | 83/13 |
| 5,197,366 | 3/1993 | Paulson et al. | 83/498 |

*Primary Examiner*—Eugenia Jones
*Assistant Examiner*—Kenneth E. Peterson
*Attorney, Agent, or Firm*—Andrus, Sceales, Starke & Sawall

[57] ABSTRACT

An air bearing assembly for supporting a running web in a paper slitting apparatus is particularly adapted for use in slitting a corrugated paperboard web and includes a flat web-supporting plate which is slotted to receive a thin annular slitting blade rotatably supported above the web. The flat supporting plate includes a series of apertures for directing a flow of compressed air upwardly through the plate to support the web on an air bearing or cushion as it travels over the plate and through the slitting blade. The air apertures are preferably concentrated along the edges of the slot. The slot is contoured to the shape of the cross sectional profile of the blade such that the slot tapers to an upstream point where the blade passes through the web and into the slot and where blade load on the web is greatest. Additional air bearing support may be provided at this point as well, and across the entire supporting surface of the plate.

10 Claims, 3 Drawing Sheets

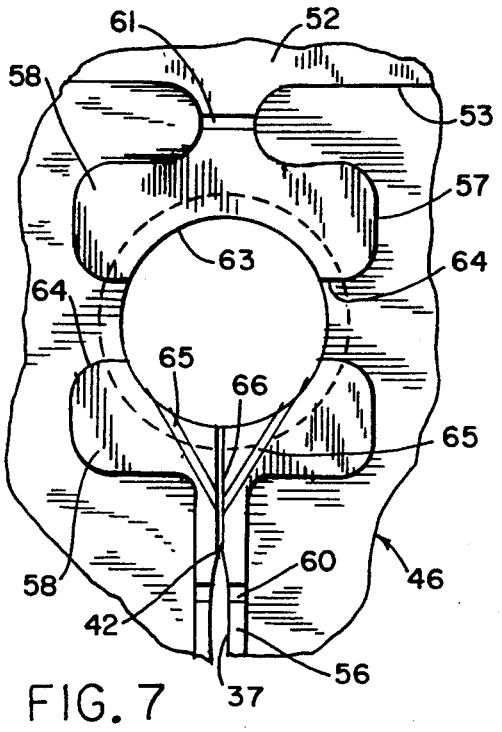
FIG. 7
FIG. 2
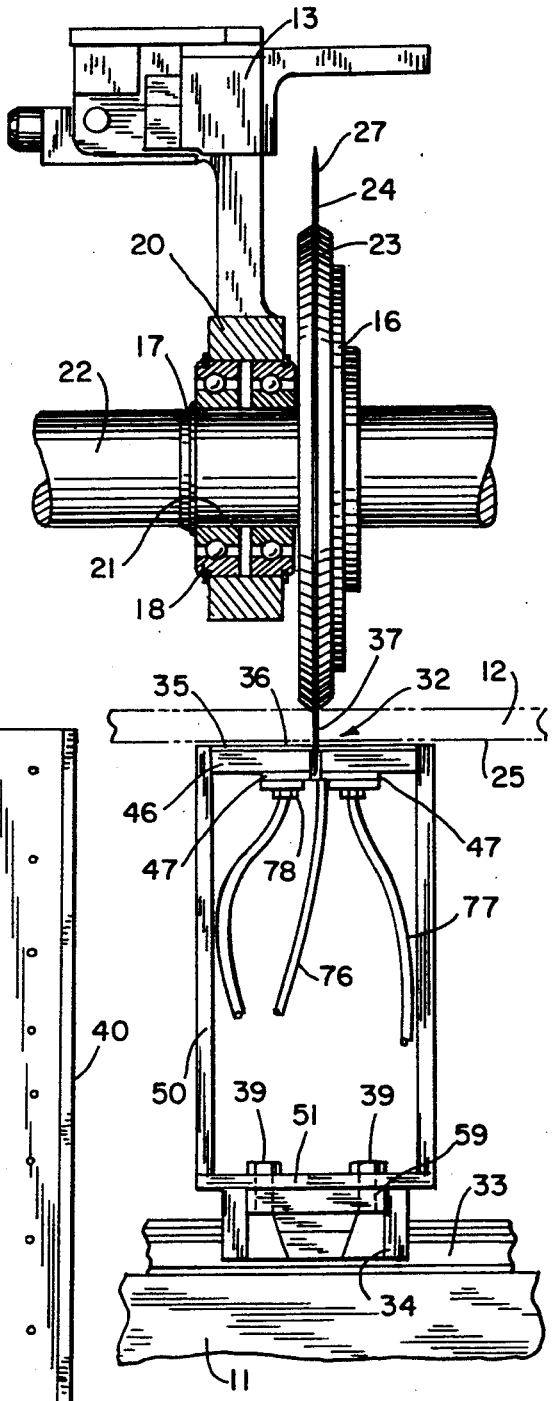
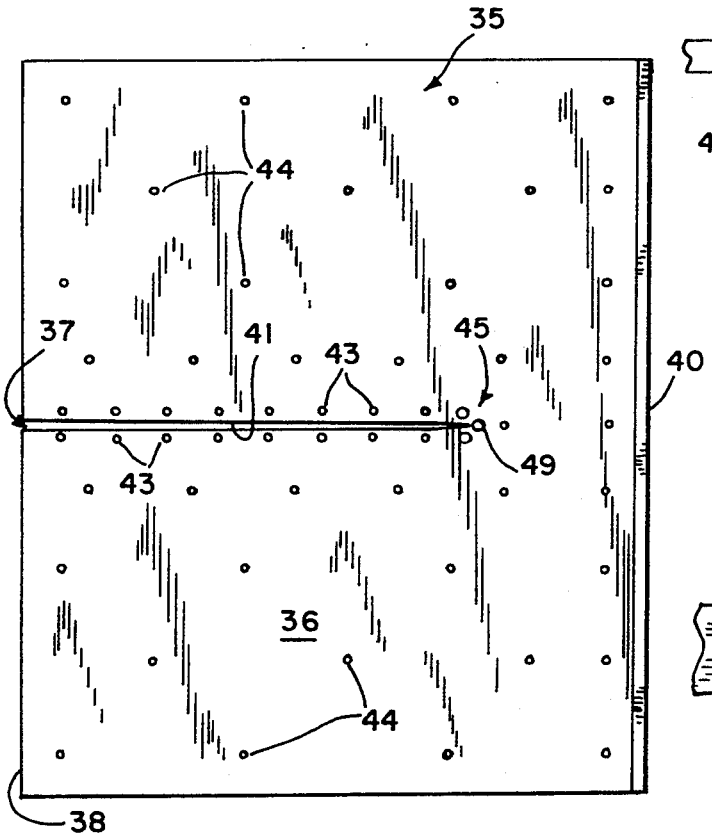
FIG. 3

AIR BEARING SUPPORT ASSEMBLY FOR PAPER SLITTING APPARATUS

BACKGROUND OF THE INVENTION

The present invention relates to an apparatus for slitting a traveling web of paper, solid fiber paperboard, corrugated or composite paperboard, or webs made of other materials, such as plastics (including foam) and, in particular, to an air bearing assembly for supporting the running web below and in cooperation with an upper rotary slitting blade.

Various types of apparatus for longitudinally slitting a continuous running web of corrugated paperboard are known in the art. Such apparatus often includes a related mechanism for simultaneously providing longitudinal score lines in the advancing web, which score lines facilitate subsequent folding in the construction of boxes or the like. Thus, a combined slitter-scorer utilizes pairs of rotatable cutting tools and scoring tools disposed in the path of the advancing web of corrugated paperboard, with one tool of each pair disposed on an opposite side of the web. Typically, multiple slitting tools are mounted coaxially and laterally spaced across the width of the web and, likewise, multiple scoring tools are also coaxially mounted and spaced across the width of the web.

A conventional prior art device is shown for example in U.S. Pat. No. 4,627,214. Each pair of upper and lower slitting tools is disposed with overlapping radial cutting edges between which the advancing paperboard web is moved to provide a continuous slit. Although commonly referred to as a "slitting" operation, the cutting tools of this type of prior art device in fact shear the moving sheet, resulting in a relative vertical displacement of the adjacent cut edges. However, problems arise as the thickness of the web increases, resulting in cuts which tend to become more ragged, edges which tend to be crushed, and a general degradation in the slit quality. Prior art methods also generate significant amounts of dust, resulting in a wide variety of well known environmental, operational, maintenance and quality control problems.

U.S. Pat. No. 5,090,281 discloses a slitting apparatus which represents a significant improvement in the above described prior art shear-type slitting apparatus. In this apparatus, the paperboard web is cut with a true slitting technique utilizing an apparatus in which the advancing web is directed through a thin circular blade rotating at high speed and running in the same direction as the web, with the board supported below the blade by rollers in contact with the underside of the web. This apparatus reduces significantly the generation of paperboard dust in the slitting operation and improves slit quality.

U.S. Pat. No. 5,197,366 is directed to improvements in the supporting roller assembly for a slitting apparatus of the type described in U.S. Pat. No. 5,090,281. The improvements minimize the build up of adhesive on the supporting rollers and the entry of adhesive, board dust and board scraps into the blade-receiving slot in the supporting rollers. The assembly also facilitates the discharge of board scrap which does enter the slot.

Although slotted supporting anvil rollers have worked quite satisfactorily and provide much improved slit quality, particularly when slitting high quality corrugated paperboard, problems with poor slit quality still occur regardless of the kind of slitting apparatus used when the quality of the paper web diminishes. With the presently increasing trend toward the use of recycled papers, the quality of paper webs in many applications has deteriorated and it has been found that these webs are more difficult to slit without producing ragged slit edges or downturned edge portions, even when utilizing the true rotary slitting apparatus described in the above identified patents. For example, recycled paper is used increasingly for one or both liners and/or the medium in the manufacture of corrugated paperboard, and solid fiber board is also increasingly being made from recycled paper stock. The quality of products made from such inherently poorer quality papers could be enhanced with better slit quality. Improving the slit quality in poorer grades of paper web would inherently also inure to the benefit of higher quality paper webs, including plain paper, solid fiber board, or corrugated paperboard.

SUMMARY OF THE INVENTION

In accordance with the present invention, an improved web supporting surface for a slitting apparatus which utilizes a thin annular rotary cutting blade includes a flat slotted supporting surface provided with an air bearing adjacent the blade-receiving slot. The air bearing supporting assembly of the present invention is particularly adapted for use with a slitting apparatus including a thin annular rotary cutting blade which is positioned with its axis of rotation on one side of a running paper web and has a peripheral cutting edge which is defined by opposite blade faces and positioned so the cutting edge extends through the path of the web to slit the web in the direction of travel. The supporting surface is positioned on the opposite side of the web to support the web at the point of slitting and includes a slot to receive the blade cutting edge. The improved apparatus of the present invention includes a flat plate which is positioned to provide a flat supporting surface upstream and downstream of the point of slitting and includes lateral surface portions which have opposed edges defining the blade-receiving slot. The supporting surface adjacent the opposed edges of the slot is provided with a plurality of apertures, which apertures are operatively connected to a source of compressed air to supply a flow of air sufficient to support at least the portion of the web along the length of the slot so it is maintained just slightly spaced from the supporting surface.

Preferably, the flat web-supporting surface is provided with a plurality of apertures disposed over substantially the entire surface of the plate. The blade-receiving slot preferably extends in an upstream direction from the downstream edge of the plate and terminates spaced from the upstream edge of the plate. In one embodiment, the surface portion edges which define the slot are contoured to conform to the cross sectional profile of the slitting blade in the plane of the supporting surface.

Means are also provided for adjustably repositioning the plate horizontally in the direction of web travel to compensate for blade wear and maintain the closely spaced relationship of the blade in the slot. The apparatus may also include a source of a blade lubricant, and an air and lubricant supply manifold is attached to the back face of the plate to interconnect the sources of compressed air and lubricant to the apertures. The slot is also preferably defined in a vertical downward direction from the supporting surface by opposed downwardly divergent side walls. The side walls may be provided with a longitudinal array of horizontally opening apertures which are operatively connected to the source of compressed air to direct the air against the blade faces within the slot.

In accordance with another aspect of the invention, a method for slitting a horizontal running web of paper comprises the steps of: positioning a thin annular rotary cutting blade with its axis of rotation on one side of the web, said blade having a peripheral cutting edge defined by opposite blade faces; extending the cutting edge through the path of the web to slit the web in the direction of web travel; supporting the other side of the web at the point of slitting with a flat supporting surface including a slot for receiving the blade cutting edge; providing the web supporting surface adjacent the slot with a plurality of apertures; and, directing a flow of compressed air from the apertures sufficient to support the web along the length of the slot to maintain it slightly spaced from the supporting surface to prevent wear.

BRIEF DESCRIPTION OF THE DRAWINGS

FIG. 2 is an end elevation of the apparatus shown in FIG. 1.

FIG. 3 is an enlarged to plan view of the assembly of the present invention.

FIG. 7 is a detail of a portion of FIG. 6.

DETAILED DESCRIPTION OF THE PREFERRED EMBODIMENT

Figure 1:
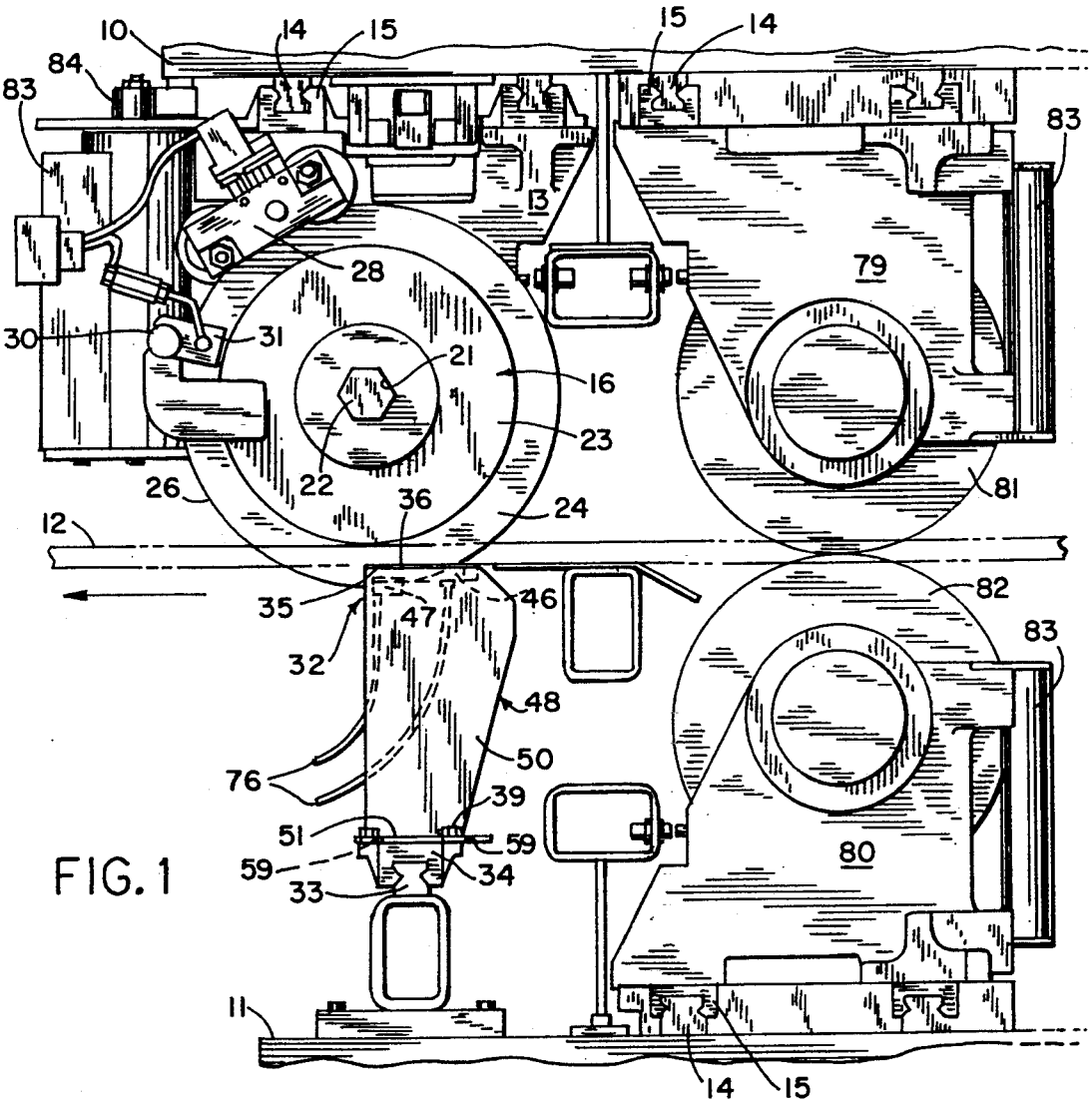
FIG. 1 is a side elevation, partly in section, showing the web supporting air bearing assembly of the present invention as part of a paper web slitting apparatus.

Referring initially to FIG. 1, the main supporting framework for a slitting apparatus with which the web supporting air bearing assembly of the present invention is utilized includes a horizontal upper beam 10 and a parallel lower beam 11. The beams 10 and 11 extend across the width of the slitting apparatus and are somewhat longer than the maximum width of a continuous moving web 12 of corrugated paperboard or other type of paper web which moves between the beams and the attached components of the slitting apparatus to be described hereinafter. A plurality of upper tool heads 13 are attached to the underside of the upper beam 10 for individual movement across the width of the web 12 on a pair of linear ways 14 attached to the beam 10. Each tool head 13 has a pair of linear bearing pads 15 attached to its upper edge, which bearing pads connect the tool head to the linear ways 14 for lateral sliding movement across the web to set the tool head in the position where a longitudinal slit in the web 12 is desired.

Referring also to FIG. 2, a rotary tool holder 16 is attached to each tool head 13. The tool holder 16 includes an inner hub 17 which forms the inner race of a rotary bearing. The outer race 18 of the rotary bearing is secured in an annular boss 20 in the tool head 13. The inner hub 17 of the tool holder has an axial through bore 21 having a non-circular cross section, such as the hexagonal shape shown in FIG. 1. The through bores 21 of the tool holders 16 mounted on a plurality of tool heads 13 lie on a common axis. A driveshaft 22 having a hexagonal cross section is mounted to extend through the bores 21 in each of the plurality of coaxially mounted tool holders 16. The driveshaft 22 extends across the full width of the apparatus and is connected at one end to suitable drive means, whereby its driving rotation causes tool holders 16 to rotate with respect to the tool heads 13. Also, the driveshaft 22 provides support for the commonly mounted tool holders 16 and tool heads 13 for movement along the linear ways 14. Each tool holder 16 includes an outer hub 23 to which a thin annular slitting blade 24 is demountably attached in a manner more fully described in U.S. Pat. No. 5,090,281. Each slitting blade 24 depends downwardly from its respective tool head 13 such that the circular cutting edge extends below the underside 25 of the corrugated paperboard web 12 as the web travels through the slitting station.

As also described in the above identified U.S. patent, the circular slitting blade 24 preferably has a smooth continuous peripheral cutting edge 26 which is defined by a pair of opposite beveled edge faces 27. Each blade may have a thickness, radially inwardly of the edge faces 27, from a minimum of about 0.020 inch (0.5 mm) adjacent the edge faces 27 to a maximum of about 0.040 (1.0 mm) adjacent the hub. Because the slitting blades 24 are operated at high speed, which may be two or more times the speed of the moving web 12, a substantial amount of heat is generated and, in addition, the blade edges eventually become dull and must be resharpened. When used to slit corrugated paperboard, particularly as it exits the wet end of a corrugating machine, the typical starch-based adhesive used to secure the multilayer paperboard web tends to stick to and build up on the cutting blade 24. Therefore, the slitting apparatus also preferably includes a sharpening device 28, whereby each blade edge may be sharpened on-the-fly. The sharpening device 28 is attached to the tool head 13 and may be periodically activated to touch each of the opposite blade edge faces 27 as required for sharpening. A lubricating device 30 may also be attached to the tool head 13 to apply a thin coating of a lubricant or anti-stick liquid to the opposite faces of the blade to prevent adhesive build up thereon. The lubricating device 30 preferably includes a pair of wick members 31 which are retained in constant light contact with the opposite faces of the blade to distribute the lubricant thereon.

A plurality of web supporting air bearing assemblies 32 of the present invention are provided, one for each slitting blade 24, and are supported for individual sliding movement along a single lower linear way 33 which, in turn, is attached to the upper surface of the lower beam 11. Each air bearing assembly 32 is supported for movement along the linear way 33 by a bearing pad 34 similar to the bearing pads 15 used to support the upper tool heads 13. Each air bearing assembly 32 includes flat upper plate 35 positioned to support the moving web 12 by contact with the underside 25 of the web on a flat top supporting surface 36 and to receive the lower edge of the slitting blade in a slot 37 in the plate as the blade projects below the underside of the web during slitting.

Referring also to FIG. 3, the blade-receiving slot 37 extends vertically through the flat plate 35 and also extends rearwardly from the downstream edge 38 and terminates spaced from the upstream edge 40. When viewed in the plan view of FIG. 3, the slot 37 preferably tapers in the upstream direction and is contoured to conform very closely to the cross sectional shape of the slitting blade 24 in the plane of the supporting surface 36. Thus, for example, the slot 37 may conform to the thickness of the tapered slitting blade described above, taking into consideration the fact that the plane of the supporting surface 36 forms a chordal line across a peripheral portion of the annular blade 24 extending into the slot 37. The opposed edges 41 of the slot 37 may provide a very close tolerance or spacing with respect to the opposite faces of the cutting blade 24 in the order, for example, of 0.0005 inch (0.013 mm). As indicated, the edges 41 of the slot taper rearwardly to a point 42 and the plate 35 may be positioned horizontally so that the point 42 of the slot actually makes light touching contact with the blade edge.

Prior art attempts to slit a paper or paperboard web with a thin, high speed annular cutting blade operating into a flat web-supporting plate have met with only marginal success. Slit quality of the paper or paperboard web has exhibited some improvement over prior art shear-type slitting apparatus, but the quality has been far lower than that attainable in slitting apparatus utilizing slotted supporting rollers of the type described in the above identified patents. The edges of the slots of planar metal supporting plates are subject to rapid and excessive wear as the result of the high loading imposed by the rapidly rotating blade forcing paper fibers into the slot. Also, a flat supporting plate over which the web slides may result in marring or damage to the previously printed web face.

In accordance with an important aspect of the present invention, the flat supporting surface 36 of the web-supporting plate 35 is provided with a plurality of upwardly opening apertures 43 located along each of the edges 41 defining the slot 37. Compressed air is caused to flow out of the apertures at a pressure sufficient to provide an air bearing extending at least along the length of the slot 37, which air bearing is sufficient to support the web above the supporting surface 36 in opposition to the downward force of the rotating slitting blade 24. The result is an extremely sharp-edged slit in the moving paper web. In particular, when the apparatus is used to slit a corrugated paperboard web 12, the ragged slit edge which is typically characteristic of high speed slitting against a flat slotted stationary supporting plate is virtually completely eliminated. It is believed that the air bearing support of the edges of the web immediately adjacent the slit prevents the downward movement and displacement of the paper fibers into the slot 37. Displacement of paper fibers into the slot by the high speed rotating blade is believed to result not only in ragged slits with prior art apparatus, but movement of the paper fibers against the edges 41 of the slot also results in extremely rapid wear and rounding of the edges. Even flat supporting plates of the prior art which are made of wear-resistant steel are subject to rapid wear as a result of the highly abrasive action of the paper fibers being forced against the edges. As the edges 41 of the slot become worn by abrasion, slit quality continues to deteriorate.

In addition to the air bearing apertures 43 lying along the edges 41 of the slot 37, the entire supporting surface 36 of the air bearing plate 35 may be provided with an array of supplemental apertures 44 spaced over the entire supporting surface 36. The supplemental apertures 44 are also operatively connected to the source of compressed air to provide additional support for the moving web 12 and to virtually eliminate direct sliding contact between the web and the supporting surface 36.

As shown in FIG. 3, the main air bearing apertures 43 along the edges 41 of the slot are most closely spaced as compared to the array of supplemental apertures 44 further from the slot 37. The diameter of the apertures 43 and 44 should be selected in conjunction with considerations such as the pressure of the available source of compressed air and the need to practically limit the aperture size in order to maintain the volume of compressed air needed within reasonable limits. For example, an aperture size of 0.030 inch (about 0.75 mm) has been found to provide adequate bearing support for the web when supplied with the compressed air at a pressure of about 30 psi (207 kPa).

Because the maximum force imposed on the web 12 by the slitting blade 24 occurs at the upstream point 42 of the slot 37, it is presently preferred to provide a cluster of apertures 45 immediately adjacent the point 42 of the slot. The supplemental apertures 44 extending laterally in both directions from the main line of apertures 43 along the slot are substantially more widely spaced, as shown.

The complete air bearing assembly 32 includes, in addition to the flat upper plate 35, an intermediate air and lubricant manifold and distribution plate 46 and a pair of lower air and oil supply plates 47. The plates 35, 46 and 47 are secured together in sandwich fashion to form the main air bearing assembly 32. The assembly is attached to the upper end of a mounting bracket 48 which includes a pair of vertical side plates 50 secured at their upper edges to the lateral side faces of the bearing assembly and at their lower edges to a bottom plate 51. The bottom plate 51 is, in turn, bolted, as with bolts 39, or similarly attached to the upper face of the bearing pad 34 for adjustable positioning in the direction of web movement. Specifically, the bottom plate 51 may be provided with longitudinally extending slotted holes 59 which allow the entire mounting bracket 48 and attached air bearing assembly 32 to be repositioned in a downstream direction as the blade diameter is reduced by wear and as the point 42 of the slot is worn by abrasive action of the blade and web material.

Figure 4:
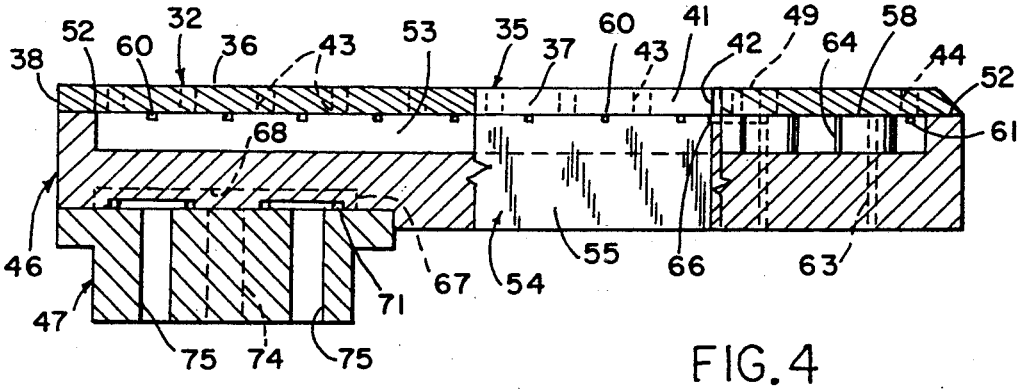
FIG. 4 is a sectional side elevation of the assembly taken on line 4—4 of in FIG. 3.
Figure 5:
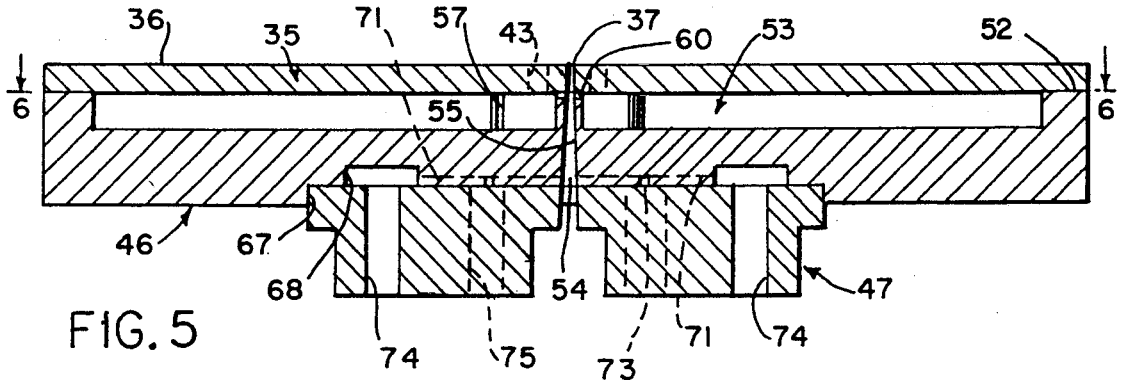
FIG. 5 is an end elevation of the FIG. 3 assembly view in an upstream direction.
Figure 6:
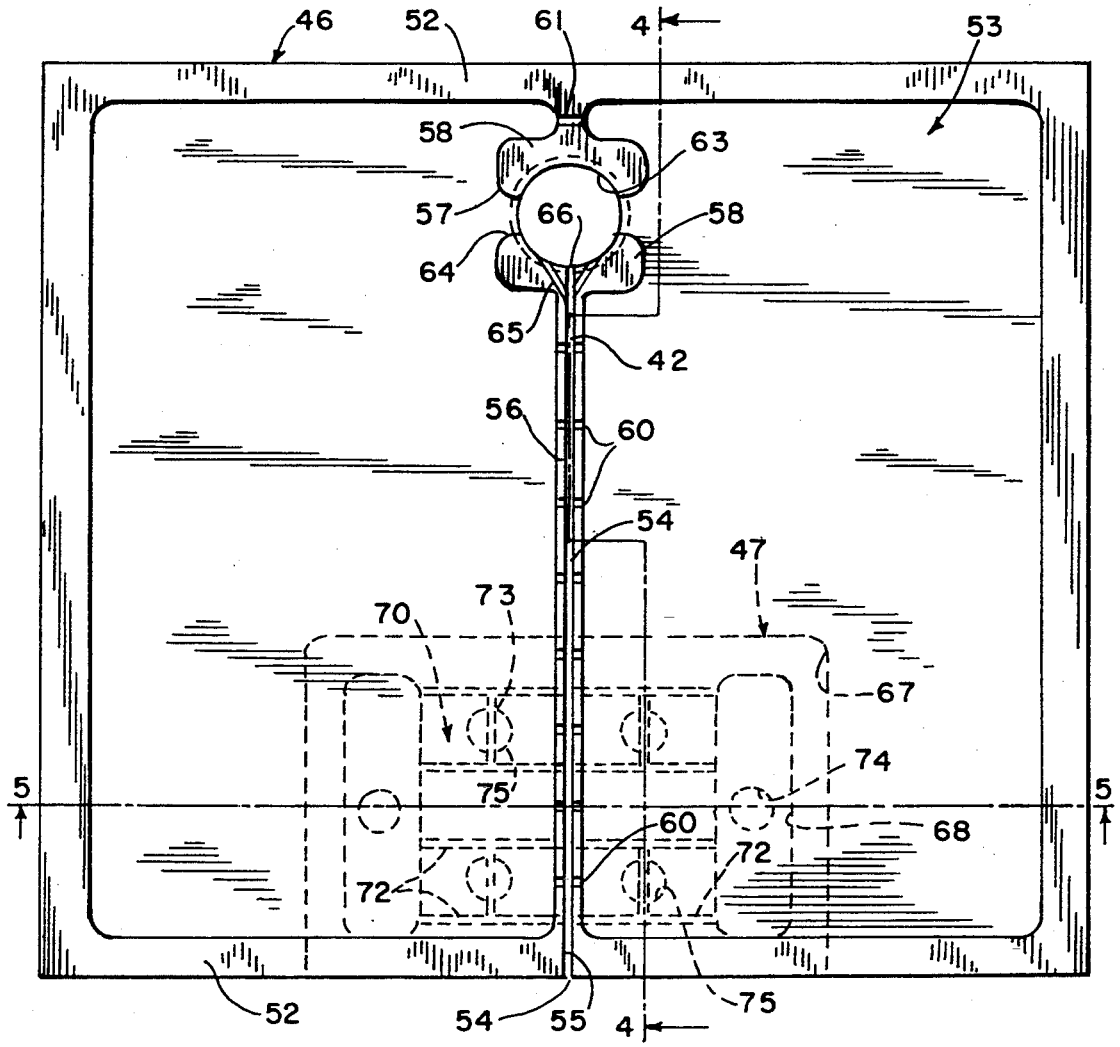
FIG. 6 is a sectional view taken on line 6—6 of FIG. 4.

Referring also to FIGS. 4–6, as previously indicated, the air and oil manifold and distribution plate 46 is of generally the same shape and area and directly underlies the upper flat air bearing plate 35. The manifold and distribution plate 46 includes a peripheral upper surface 52 which directly abuts and is sealed to the flat lower surface of the upper plate 35. The peripheral upper surface 52 defines an air distribution chamber 53 which is in direct open communication with each of the sets of apertures 43, 44 and 45 in the web supporting surface 36 of the upper plate. The main blade-receiving slot 37 in the upper plate 35 also extends downwardly in the form of a lower slot 54 in the distribution plate 46 defined by a pair of opposed slot side walls 55. Preferably, the side walls 55 are downwardly divergent, as shown in FIG. 5, to help keep the slot clear of paperboard particles, starch, and the like. The upper ends of the side walls 55 include side wall surface portions 56 which extend rearwardly or in an upstream direction from the open downstream edge of the slot to a point where the surface portions join at the point of the slot to form an enlarged boss 57 at the center rear of the air distribution chamber 53. The peripheral upper surface 52, surface portions 56 and the upper boss surfaces 58 all lie coplanar and form a continuous sealing surface with the underside of the upper bearing plate 35.

Each of the surface portions 56 has formed therein a series of opposed pairs of notches 60 which provide open channels from the interior air distribution chamber 53 to the slot 54. The notches 60 are enclosed by the lower face of the upper plate 35 and provide a series of air passages which direct compressed air from the chamber 53 directly against the side faces of the slitting blade 24, simultaneously with the upward flow of compressed air from the chamber 53 through the apertures 43, 44 and 45 which provide the direct air bearing support of the moving web 12. The intermediate surface portion 62 between the peripheral upper surface 52 and the boss surface 58 includes an air distribution channel 61 to supply air to the aperture 44 centered in the row of apertures along the rear edge 40 of the plate.

As best shown in FIG. 6, air is supplied to the distribution plate 46 vertically from below through a main air supply opening 63 formed in the boss 57. The boss, in turn, is divided by a main air supply channel 64 through which compressed air from the supply opening 63 is directed laterally into both sides of the air distribution chamber 53, and thence upwardly through the apertures or laterally through the notched openings 60 in the slot side walls 55.

The aperture cluster 45 (FIG. 3) which provides air bearing support to the web right at the point 42 of the slot includes a center aperture 49 which lies immediately above the left side boss surface 58 (FIG. 6) and, because this is effectively a sealing surface which engages the flat underside of the upper plate 35, supplemental air passages 65 are formed in the surface 58 to supply compressed air from the main air supply opening 63 directly to the aperture 49. The supplemental air passages 65 include two diagonally oriented outside passages and a central passage 66 which extends beneath the center aperture 49 of the cluster and intersects the point of the center plate slot 54 to direct a supplemental flow of air directly against the blade edge 26.

Because the web supporting surface 36 of the upper plate 35 is subject to so little wear by the running web 12, the plate 35 may be made of a tough, wear resistant plastic material such as ultra-high molecular weight polyethylene.

The air bearing assembly 32 also includes provision for supplying a lubricant to the blade which may be supplemental to or in lieu of the lubricating device 30. The bottom of the intermediate manifold and distribution plate 46 includes on its lower surface near the downstream end of the slot 54 a manifold chamber 67 which is bisected by the slot. The portions of the manifold chamber 67 on each side of the slot 54 include a recessed air manifold 68 and a network of air/oil supply channels 70 cut in the manifold chamber surface and interconnecting the air manifold 68 and the slot 54 in the center plate 46. Each of the air/oil supply channel networks 70 includes a pair of H-shaped portions 71 comprising a pair of main legs 72 interconnected by a cross leg 73. The main legs extend directly from the air manifold 68 through the side walls 55 to open into the slot 54. The cross leg 73 provide open connection to the main legs 72. An air/oil supply plate 47 is placed in the recessed manifold chamber 67 on each side of the slot 54 and secured therein in any convenient manner. Each air/oil supply plate 47 includes a series of through holes which include an air supply passage 74 in communication with the air manifold 68 and a pair of oil supply passages 75 in communication with the cross legs 73 of each H-shaped supply channel portion 71. The air supply passages 74 are connected to a suitable source of compressed air which may be the same source supplying compressed air to the main air supply opening 63 in the air distribution chamber 53. Alternately, appropriate connections may be cut in the manifold and distribution plate 46 to interconnect the air distribution chamber 53 and the air manifolds 68 so that compressed air can be supplied through the main air supply opening 63. Each of the oil supply passages 75 for each air/oil supply plate 47 is connected to a metered low volume supply of a liquid lubricant which may comprise conventional mineral oil, vegetable oil, soapy water, or the like. The low volume supply of lubricant fed to the cross legs 73 is picked up in the compressed air streams flowing through the main legs 72 and directed into the slot 54 directly against the side faces of the slitting blade 24. As discussed in greater detail in the above identified patents, the primary purpose of the lubricant is to prevent a detrimental build up of starch and paperboard particles on the blade faces, but the air/oil mixture directed through the supply channels 70 also is believed to provide a cooling effect as well.

Referring again also to FIGS. 1 and 2, the main air supply opening 63 in the intermediate manifold distribution plate 46, each of the two air supply passages 74 and the four oil supply passages 75 in the pair of supply plates 47 are supplied by respective air and oil lines 76 and 77 with connections made by conventional compression fittings 78 or the like.

As shown in FIG. 1, in addition to the plurality of upper tool heads 13 (each carrying a slitting blade 24) and the corresponding lower air bearing assemblies 32, the slitting apparatus of the present invention is most commonly incorporated into a slitter/scorer machine in which each of the upper and lower beams 10 and 11, respectively, carries a plurality of upper and lower scoring heads 79 and 80 carrying, respectively, rotary upper and lower scoring tools 81 and 82. Each blade carrying upper tool head 13, upper scoring head 79, and lower scoring head 80 is individually positionable in a lateral direction along its respective linear ways 14 by an electric servomotor 83 and cooperating rack and pinion drive 84 all in a manner well known in the art. Lateral repositioning movement of each blade carrying upper tool head 13 carries with it the corresponding air bearing assembly 32 by virtue of engagement of the blade edge in the air bearing slot 37, causing the air bearing mounting bracket 48 to slide along the lower linear way 33. Also as is well known in the art, when it is desired to reposition the slitting blade/air bearing assembly and/or the scoring tools 81 and 82 to effect an order change, a gap is created in the moving web 12, the upper beam 10 is rotated slightly on a transverse horizontal axis to lift the upper scoring tools vertically from the path of the web, and the tools are repositioned as indicated above, again in a manner well known in the art.

Various modes of carrying out the present invention are contemplated as being within the scope of the following claims particularly pointing out and distinctly claiming the subject matter which is regarded as the invention.

We claim:

1. In an apparatus for slitting a horizontal running paper web, said apparatus including a thin annular rotary cutting blade positioned with its axis of rotation on one side of the web and having a smooth peripheral cutting edge defined by opposite blade faces, said cutting edge extending through the path of the web to slit the web in the direction of web travel, and a supporting surface on the other side of the web for supporting the web at the point of slitting and including a slot in the supporting surface for receiving the blade cutting edge, the improvement in said apparatus comprising:

a flat plate positioned to provide a flat supporting surface upstream and downstream of the point of slitting and including lateral surface portions having opposed edges defining the slot;

aperture means in the supporting surface adjacent said opposed edges operatively connected to a source of compressed air to supply a flow of air therethrough sufficient to support a portion of the running web along the length of the slot spaced slightly from the supporting surface for preventing the entry of paper fibers into the slot and abrasive contact between components of the paper and the slot edges to prevent wear of said slot edges and to maintain tolerance between said slot edges and said blade.

2. The apparatus as set forth in claim 1 comprising a plurality of supplemental apertures disposed over substantially the entire: flat supporting surface of the plate.

3. The apparatus as set forth in claim 1 wherein the slot extends in an upstream direction from the downstream edge of the plate.

4. The apparatus as set forth in claim 3 wherein the slot terminates spaced from the upstream edge of the plate.

5. The apparatus as set forth in claim 4 wherein the surface portion edges defining the slot are contoured to conform to the slitting blade cross sectional profile in the plate of the supporting surface.

6. The apparatus as set forth in claim 5 including means for adjustably repositioning said plate horizontally in the direction of web travel.

7. The apparatus as set forth in claim 1 including:

a source of a lubricant; and, an air and lubricant supply manifold attached to the back face of the plate and operatively interconnecting said sources of compressed air and lubricant to said aperture means.

8. The apparatus as set forth in claim 1 wherein said slot vertically downwardly of the supporting surface is defined by opposed downwardly divergent side walls.

9. The apparatus as set forth in claim 8 including a longitudinal array of horizontally opening apertures in said side wall operatively connected to the compressed air source and positioned to direct compressed air against the blade faces within said slot.

10. A method for slitting a horizontal running paper web, comprising the steps of:

(1) positioning a thin annular rotary cutting blade with its axis of rotation on one side of the web, said blade having a peripheral cutting edge defined by opposite blade faces;

(2) extending said cutting edge through the path of the web to slit the web in the direction of web travel;

(3) supporting the other side of the web at the point of slitting with a flat supporting surface including a slot for receiving the blade cutting edge;

(4) providing the web supporting surface adjacent the slot with aperture means; and, (5) preventing the entry of paper fibers into the slot and abrasive contact between components of the paper and the slot edges to prevent wear of said slot edges and to maintain tolerance between said slot edges and said blade by directing a flow of compressed air from said aperture means sufficient to support the web along the length of the slot spaced slightly from the supporting surface.

* * * * *